United States Patent [19]

Queen

[11] Patent Number: 4,721,418

[45] Date of Patent: Jan. 26, 1988

[54] FRICTION BARRIER PILE JACKET

[76] Inventor: Frankie A. R. Queen, 668 Nottingham Dr., Lawrenceville, Ga. 30245

[21] Appl. No.: 941,770

[22] Filed: Dec. 15, 1986

[51] Int. Cl.[4] ..... E02D 5/60; E02D 5/22

[52] U.S. Cl. ..... 405/231; 405/257; 405/284

[58] Field of Search ..... 405/130, 216, 231, 232, 405/250–257, 262, 277, 285, 211, 217, 284, 286; 52/167, 170, 725, 727–729; 14/26, 75

[56] References Cited

U.S. PATENT DOCUMENTS

| | | | |
|---|---|---|---|
| 1,709,893 | 4/1929 | Bemis . | |
| 1,947,413 | 2/1934 | Hay . | |
| 2,928,411 | 3/1960 | Johnson | 137/236 |
| 3,141,306 | 7/1964 | Liddell | 55/146 |
| 3,166,871 | 1/1965 | Simison . | |
| 3,327,441 | 6/1967 | Kelley | 52/309 |
| 3,403,520 | 10/1968 | Goodman . | |
| 3,487,646 | 1/1970 | Gatier | 405/257 |
| 3,495,565 | 2/1970 | Gustavii | 114/230 |
| 3,981,038 | 9/1976 | Vidal | 14/26 |
| 4,019,301 | 4/1977 | Fox | 405/216 X |
| 4,069,677 | 1/1978 | Yamada et al. | 405/262 X |
| 4,081,941 | 9/1978 | Van Ausdall | 405/216 X |
| 4,114,388 | 9/1978 | Straub | 405/216 |
| 4,386,876 | 6/1983 | Dupeuble | 405/262 X |
| 4,397,589 | 8/1983 | Darroussin et al. | 405/262 X |
| 4,464,083 | 8/1984 | Wathey | 405/216 |
| 4,585,681 | 4/1986 | Kidera et al. | 405/216 X |

FOREIGN PATENT DOCUMENTS

| | | | |
|---|---|---|---|
| 1173701 | 3/1959 | France | 405/216 |
| 223521 | 11/1985 | Japan | 405/231 |

*Primary Examiner*—Nancy J. Stodola
*Attorney, Agent, or Firm*—Thomas & Kennedy

[57] ABSTRACT

A pile jacket (15) is placed about a pile (14) before backfill earth (45) is filled in about the pile. The pile jacket (15) is formed of laminated sheet material (20) having opposed, parallel spaced outside sheets (21 and 22) and with intermediate supporting ribs (24) that maintain the outside sheets in spaced relationship. The indentations (48) made by the backfill earth (45, 46) in the pile jacket generally do not destroy the flat abutment of the inside sheet (21) with the surface of the pile, so that a slip plane is maintained between the pile jacket and the pile, permitting the pile jacket to move downwardly when the backfill material settles without transmitting a major downward load from the backfill material to the pile.

8 Claims, 8 Drawing Figures

FRICTION BARRIER PILE JACKET

FIELD OF THE INVENTION

This invention relates generally to pile supports for bridges and other structures, wherein the pile are driven into the earth and backfill earth and the like is placed about the pile. More specifically, the invention relates to a barrier placed about a pile which avoids the downward settling forces of the backfill earth from applying a downward load to the pile.

BACKGROUND OF THE INVENTION

In the construction of bridges and other structures in which pile supports are driven into the earth and are used as supports for the bridge, etc. it is common to form abutment walls about the piles and to backfill the space between the abutment walls and the piles with earth and other materials. For example, U.S. Pat. No. 3,981,038 discloses a backfill barrier wall formed of panels mounted one upon the other and held together with elongated reinforcing straps. As the wall is constructed, the backfill earth is placed in layers beside the wall and about the supporting piles of the bridge abutment.

One of the problems encountered with bridges and other objects supported by piles with backfill earth placed about the piles is that the backfill earth tends to settle over a length of time, and the downward movement of the backfill earth applies a downward load to the piles. The surface friction of the backfill earth with respect to the facing surfaces of the piles tends to transmit a substantial amount of the vertical load of the backfill earth to the pile. This added load tends to deteriorate the piles, sometimes causing enough stress that the piles bend or otherwise become deformed.

One of the prior art techniques for avoiding the application of the downward force from the backfill material against piles is to surround the piles with corrugated steel conduits before the backfill earth is placed adjacent the piles, and filling the tubes with sand, or the like. The relatively fluid sand does not have as much ability to apply the downward forces to the piles, and the circular shape of the steel corrugated conduits tend to shield the pile from the pressure applied by the backfill earth. As a result, the downward settling movement of the backfill earth is applied to the corrugated conduit which tends to move downwardly with the downward movement of the backfill earth, but this downward movement is generally not transmitted from the steel corrugated conduit inwardly through the fill sand to the pile. This generally protects the pile from the downward forces of the backfill earth.

While the aforementioned conduit and sand arrangement has been successful in avoiding deterioration of bridge abutment piles, etc., due to the downward weight applied by settling backfill earth, the use of the corrugated steel conduit and sand in this arrangement is expensive in that the materials are relatively expensive and the labor required to telescopically mount the steel conduits over the piles and then to fill the conduits with sand is expensive.

SUMMARY OF THE INVENTION

Briefly described, the present invention comprises a friction barrier pile jacket which is placed about a pile of a bridge abutment structure, or the like, before the backfill earth is placed adjacent the piles. The pile jacket comprises sheet material formed in a size and shape suitable for surrounding the pile and for conforming to the exterior shape of the pile so that the pile jacket is in flush abutment with all peripherial surfaces of the pile.

Preferably, the sheet material comprises opposed, parallel outside surfaces maintained in spaced relationship by inner spacing material. One example of sheet material suitable for use in the pile jacket is laminated material comprising opposed outside sheets and intermediate material which maintains the outside sheets in parallel, spaced relationship.

When the pile jacket is applied to the pile, the surface of the pile jacket that faces the pile is supported by the pile, whereas the outside surface of the pile jacket is contacted by the backfill earth. Some portions of the backfill earth tend to form indentations in the outer sheet of the pile jacket, but the pile jacket tends to shield the pile from direct contact with the surface of the pile, such that the surface of the pile jacket facing the pile remains substantially flat, and forms a slip plane with respect to the surface of the pile. Thus, the downward forces applied by the backfill earth through the pile jacket tend to move the pile jacket downwardly with the downward movement of the earth, but the slip plane between the pile jacket and the pile tends to avoid the transmission of the downward forces of the backfill earth to the pile itself. Thus, settling of the backfill earth does not transmit destructive downward forces to the pile.

Thus, it is an object of this invention to provide a friction barrier pile jacket for mounting about piles of the type used in bridge abutments and other structures wherein backfill earth is to be placed about the piles, whereby the pile jacket tends to avoid the transmission of downward settling forces applied by the backfill earth to the pile.

Another object of this invention is to provide an inexpensive pile jacket for placement about bridge abutment piles, whereby the pile jacket can be easily installed and is effective to avoid the transmission of the weight of backfill earth to the pile.

Another object of this invention is to provide a friction barrier pile jacket which is to be wrapped about a vertical support pile for a bridge abutment and the like and then backfill earth is to be placed about the jacket, with the pile jacket being formed of relatively soft sheet material that has one flat surface supported by the pile and an outer, opposed surface that can be indented by the backfill earth, substantially without transmitting surface friction from the backfill earth to the pile and thereby forming a slip plane between the pile jacket and the pile.

Other objects, features and advantages of this invention will become apparent upon reading the following specification, when taken in conjunction with the accompanying drawings.

DETAILED DESCRIPTION

Figure 1:
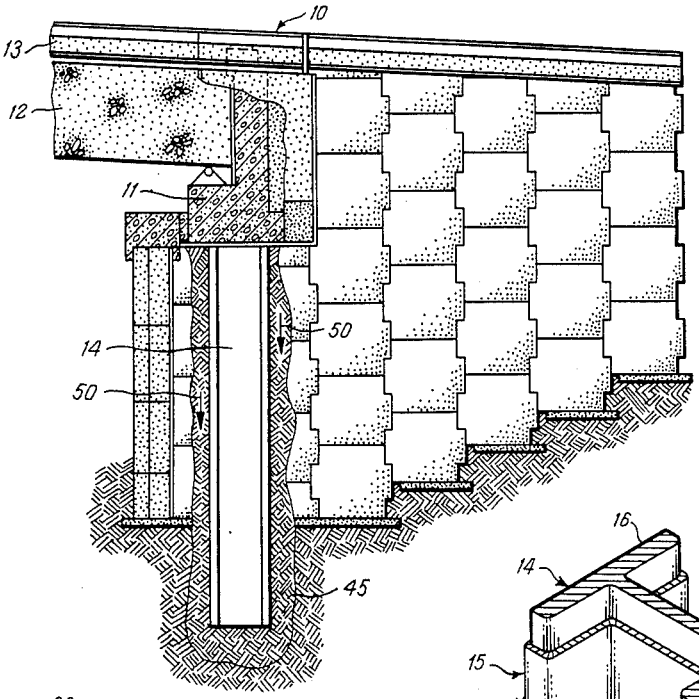
FIG. 1 is a partial side elevational view of a bridge abutment structure, with parts broken away to show a pile surrounded by backfill earth.

Referring now in more detail to the drawings, in which like numerals indicate like parts throughout the several views, FIG. 1 discloses a bridge abutment assembly 10 which includes a cap or an abutment 11 that supports a girder 12 which in turn supports a deck 13. The cap 11 is mounted on a plurality of piles 14 (only one shown). The piles 14 typically are driven by a pile driver downwardly into the earth, with the upper ends being truncated in a common plane so as to support the cap 11.

Figure 4:
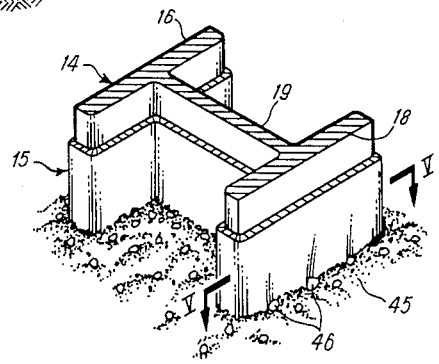
FIG. 4 is a perspective view of an H-shaped pile and its friction barrier pile jacket.
Figure 3:
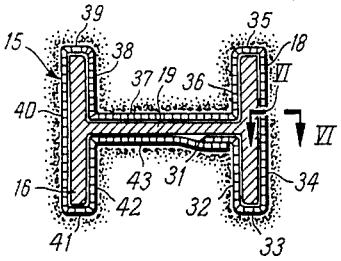
FIG. 3 is a horizontal cross sectional illustration of an H-shaped pile, with the friction barrier pile jacket in place about the pile.
Figure 2:
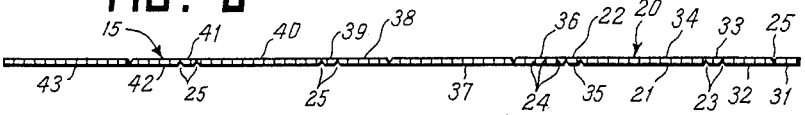
FIG. 2 is an edge view of the friction barrier pile jacket after it has been scored but before it has been folded and mounted about a pile.

As illustrated in FIGS. 2, 3 and 4, the friction barrier pile jacket 15 comprises sheet material that is to be placed in surface to surface abutment with respect to the laterally facing surfaces of the pile 14. In the embodiment illustrated in FIGS. 3 and 4, the pile is H-shaped in cross section and includes flanges 16 and 18 and web 19 joined at its edges to the flanges. The pile 14 is substantially of uniform size and shape throughout its entire length.

Figure 5:
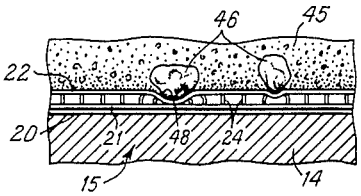
FIG. 5 is a cross section of a portion of the pile jacket, taken along lines 5—5 of FIG. 4, showing how some of the backfill earth tends to form indentations in one surface of the pile jacket whereas the other surface of the pile jacket remains substantially flat.
Figure 6:
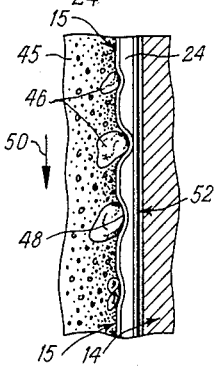
FIG. 6 is another cross section of a portion of the pile jacket, taken along lines 6—6 of FIG. 3.

As shown in FIGS. 5 and 6, pile jacket 15 comprises a lamination of sheet materials 20, including opposed outside sheets 21 and 22 and spacers 24 formed between the sheets 21 and 22 and maintaining the sheets 21 and 22 in parallel, spaced relationship. An example of the laminated sheet material is laminated corrugated cardboard, whereby the intermediate spacers 24 are formed by an intermediate corrugated sheet adhesively connected to the outside sheets 21 and 22. Another example of suitable sheet material is polyethylene sheets formed by extrusion, with the extruded shape comprising parallel sheets maintained in spaced relationship by ribs or flutes extending between and joined to the parallel sheets. One such commercial embodiment of this material is known as Coroplast, a product of Coroplast, Inc. of Erving, Tex.

As illustrated in FIG. 2, the laminated sheet material 20 is formed with parallel scores 25, with the scores 25 being spaced across the width of the sheet material at distances that correspond to the dimensions of the outside surface of the H-shaped pile 14. The scores 25 are parallel to the spacers 24 and function to reduce the thickness of the laminated sheet and enable the sheet to be accurately folded along the lengths of the scores. With this arrangement, the sheet material can be scored at the factory but remain in a flat configuration during shipment and storage at the job site. When the worker is ready to install a pile jacket 15 about a pile 14, the worker folds the laminated sheet at the scores so as to form the sheet in the H-shape of the pile 14. It will be noted that some of the scores 25 are located on one side of the laminated sheet 20, whereas some of the other scores are located on the opposite side. The location of each score tends to inform the worker as to what direction the fold is to be made, with the score being on the side toward which the sheet material is to be folded. However, if the scores 25 are all formed on one surface of the sheet material 20, the sheet material can be folded and installed properly about its pile.

It will be understood that the size of the jacket 15 and the distances between the scores 25 will vary for piles of different sizes and shapes.

As best illustrated in FIGS. 2 and 3, the friction barrier pile jacket 15 of the embodiment disclosed herein includes twelve scores that define thirteen panels, panels 31–43. The first panel 31 is of relatively small width and is to be folded into the crotch between the central web 19 and side plate 18. The next panels are then wrapped in series about the H-shaped pile. It will be noted that panel 36 tends to wedge into the space between side plates 16 and 18 of the pile. Likewise, panel 43 tends to wedge into the opposite space on the other side of central web 19, between the side plates 16 and 18. Thus, panel 43 tends to lock panel 32 into static position with respect to the H-shaped pile. Thus, no fasteners, adhesives, tapes, etc. are required to firmly mount the pile jacket to the pile.

The worker can be instructed to coat either the inside surface of the pile jacket which faces the pile or the exposed lateral surfaces of the pile with a lubricant, such as grease, so as to reduce the sliding friction between the pile and the facing surfaces of the pile jacket, if necessary. Also, the inwardly facing surface of the pile jacket can be pretreated at the factory with a suitable lubricant, if desired, so that the step of application in the field can be avoided.

It will be noted that the scores 25 are applied to the laminated sheet material 20 in a direction extending parallel to the spacers 24. This tends to make the step of folding the laminated sheet material easier.

The pile jackets usually will be formed in lengths of four feet so as to be convenient to the worker when installing the pile jackets about the piles. However, the lengths of the jackets can vary to meet the circumstances. Usually, several pile jackets will be required to cover a single pile. Usually the worker will be instructed to overlap the lower portion of one pile jacket about the pile jacket next below so that the entire surface of the pile 14 will be covered by the series of vertically placed pile jackets.

After the pile jackets have been mounted about a pile 14, backfill earth 45 is filled in about the pile and its pile jacket. The backfill earth can comprise any kind of soil, and usually will be of nonuniform granular substances such as to include various types of rock and other rigid objects 46. The backfill earth 45 tends to press the pile jacket 15 into flat abutment with the flat surfaces of the pile 14. Thus, the flat surfaces of the pile 14 tend to support the facing sheet of the pile jacket in a flat configuraton. However, the outer surface of the pile jacket which faces the backfill is likely to be indented with the various rocks and other objects 46 in the backfill. For example, FIGS. 5 and 6 illustrate rocks 46 which have been pressed by the other backfill material into the pile jacket 15. As illustrated in FIG. 5, the rocks 46 have caused an indentation 48 which tends to crush the laminated sheet material 20, with the outer sheet 22 being indented at 48, but with the inner sheet 21 remaining substantially flat and in flat abutment with the pile 15. The spacers 24 tend to withstand most of the load of the backfill material 45 except where the rocks, etc. 46 have formed the indentations 48 in the laminated sheet of the pile jacket. Thus, the spacers 24 tend to evenly distribute the major load of the backfill earth 45 to the sheet 21 which is in abutment with the pile. In those instances where a rock, etc. 46 tends to form an indentation in the outer sheet 22, the outer sheet forms a cushion between the rock and the inner sheet 21, thereby tending to spread the force of the rock 46. This further tends to maintain the inner sheet 21 in a flat configuration, avoiding direct contact between the backfill earth 45 and the pile 14.

As illustrated in FIGS. 1 and 6, when the load or weight of the backfill material 45 tends to settle as indicated by direction arrow 50, the backfill material 45 tends to move the pile jacket 15 downwardly with respect to the pile 14, with the facing surfaces of the pile 14 and the pile jacket 15 forming a slip plane 52. This tends to avoid having the downward moving load of the backfill material 45 from being transferred to the pile 14.

Figure 8:
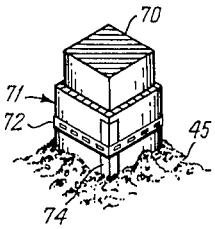
FIG. 8 is a perspective view of a rectangular pile and a friction barrier pile jacket wrapped about the rectangular pile.
Figure 7:
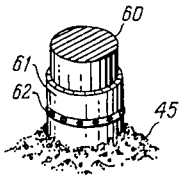
FIG. 7 is a perspective view of a cylindrical pile and a friction barrier pile jacket wrapped about the cylindrical pile.

As illustrated in FIGS. 7 and 8, the principle of the friction barrier pile jacket can be applied to piles of other shapes. For example, FIG. 7 shows a cylindrical pile 60 while FIG. 8 shows a rectangular pile 70. The pile jackets 61 and 71 are formed to the shape of their respective piles, by bending the pile jackets about the piles. The bands 62 and 72 and tape 74 are used to hold the pile jackets 61 and 71 to their respective piles. Other connecting devices can be utilized, if desired, such as adhesives, clamps, etc. Preferably, the entire lateral surface of the pile is to be covered with the pile jacket so that none of the backfill earth 45 will contact the vertical surfaces of the pile. As with the pile jacket 15 which is applied to the H-shaped pile, the pile jackets 61 and 71 are formed with the interior support ribs extending vertically so that the pile jacket can be easily folded or formed about a vertical axis.

The foregoing description and the drawings set forth the pile jacket as being formed of only the two outside sheets and the intermediate ribs; however, additional layers of the materials can be used as may be desired when considering the strength of the materials and forces to be applied to the jacket. Further, while only laminated sheet material with internal support ribs supporting the outer sheets has been disclosed, other sheet material can be used, whereby indentations can be formed in one surface by the backfill material without causing a distortion of the surface abutting the pile.

It should be understood that the foregoing description relates only to preferred embodiments of the present invention, and that numerous modifications or alterations may be made therein without departing from the spirit and scope of the invention as set forth in the appended claims.

I claim:

1. In combination, a pile including substantially smooth vertical surfaces to be surrounded by backfill and a friction barrier pile jacket surrounding said pile to be held in abutment with said pile by the backfill, said jacket comprising sheet material of a shape conforming to the shape of the vertical surfaces of the pile, said sheet material comprising opposed inner and outer surfaces and spacer means normally maintaining said inner and outer surfaces in spaced parallel relationship, said inner surfaces of said sheet material facing the pile to be maintained in a relatively smooth shape by the outer surfaces of the pile and said outer surfaces of the sheet material to be engaged by the backfill with indentations formed by the backfill in said outer surfaces of the sheet material and increasing the coefficient of friction between the backfill and said outer surface, whereby any downward forces applied by the backfill to the jacket tend to move the jacket downwardly about the pile substantially without transmitting a major portion of the downward forces to the pile.

2. The jacket of claim 1 and wherein said sheet material comprises a lamination of parallel outside sheets with a plurality of intermediate spacer ribs extending normal to said outside sheets, whereby particles of the backfill earth can form indentations in the outside sheet adjacent the backfill earth and the other outside sheet is supported by the surface of the pile and tends to remain flat.

3. The pile jacket of claim 1 and wherein said sheet material comprises laminated sheets including opposed parallel sheets and an inner corrugated sheet that holds said parallel sheets in spaced parallel relationship, whereby one parallel sheet is positioned in flat abutment with the surface of the pile and the backfill earth engages and indents the other parallel sheet.

4. The jacket of claim 1 and wherein the sheet material is formed with a plurality of parallel scores at intervals corresponding to the size and shape of the pile so that the sheet material is foldable at its scores into a shape that conforms to the shape of the pile and is wrapped about the pile.

5. The jacket of claim 1 and wherein said sheet material is formed with a plurality of parallel scores at intervals corresponding to the cross sectional shape of an H-shaped pile so that the sheet material is foldable at its scores into a shape that conforms to the pile and is wrapped about the pile.

6. The jacket of claim 1 and wherein at least one of the facing surfaces of the pile and sheet material are coated with a lubricant.

7. A friction barrier pile jacket applied to a pile, said pile including substantially smooth exterior vertical surfaces and a substantially uniform cross sectional shape along its length, said pile and said jacket surrounded by backfill, said jacket comprising sheet material surrounding the pile and formed in a shape conforming to the exterior vertical surfaces of the pile and including inner surfaces facing the pile and outer surfaces facing away from the pile, with the inner surfaces of the sheet material facing the pile in parallel sliding abutting relationship with the outer vertical surfaces of the pile, backfill placed about the jacket with the lateral forces applied by the backfill against the jacket urging the jacket toward the pile and forming indentations in the outer surfaces of the sheet material of the jacket and the inner surfaces of the sheet material of the jacket being supported by the pile vertical surfaces generally without forming indentations in the inner surfaces of the sheet material, and the coefficient of sliding friction between the backfill and the outer surfaces of the jacket contacted by the backfill being greater than the coefficient of sliding friction between the pile and the inner surfaces of the jacket because of the indentations formed by the backfill, whereby any downward forces applied by the backfill to the jacket tend to move the jacket downwardly about the pile substantially without transmitting a major portion of the downward forces to the pile.

8. The friction barrier pile jacket of claim 7 and wherein said sheet material comprises opposed spaced sheets and intermediate spacer ribs normally maintaining said outer sheets in spaced parallel relationship, whereby particles of the backfill contacting the jacket form indentations in the sheet of the jacket adjacent the backfill material and the other sheet of the jacket facing the pile is supported by the abuting surface of the pile and tends to remain flat.

* * * * *